United States Patent [19]

Boyer

[11] Patent Number: 4,915,087

[45] Date of Patent: Apr. 10, 1990

[54] IGNITION SYSTEM WITH ENHANCED COMBUSTION AND FAULT TOLERANCE

[75] Inventor: Wesley D. Boyer, Dearborn, Mich.

[73] Assignee: Ford Motor Company, Dearborn, Mich.

[21] Appl. No.: 250,668

[22] Filed: Sep. 29, 1988

[51] Int. Cl.[4] ..... F02P 3/04; F02P 3/55

[52] U.S. Cl. ..... 123/620; 123/630; 123/643; 123/656

[58] Field of Search ..... 123/620, 622, 637, 640, 123/641, 643, 655, 656, 630

[56] References Cited

U.S. PATENT DOCUMENTS

| | | | |
|---|---|---|---|
| 3,874,349 | 4/1975 | Fitzner | 315/209 |
| 4,015,564 | 4/1977 | Fitzner | 123/602 |
| 4,083,347 | 4/1978 | Grather et al. | 123/146.5 A |
| 4,136,301 | 1/1979 | Shimojo et al. | 315/209 T |
| 4,345,575 | 8/1982 | Jorgensen | 123/598 |
| 4,462,380 | 7/1984 | Asik | 123/620 |
| 4,556,040 | 12/1985 | Heyka | 123/655 X |
| 4,658,799 | 4/1987 | Kusoka et al. | 123/622 |

FOREIGN PATENT DOCUMENTS

| | | | |
|---|---|---|---|
| 2139360 | 5/1981 | Fed. Rep. of Germany | 123/656 |
| 214670 | 12/1983 | Japan | 123/656 |

*Primary Examiner*—Tony M. Argenbright

*Attorney, Agent, or Firm*—Allan J. Lippa; Peter Abolins

[57] ABSTRACT

An ignition system having a first primary coil magnetically coupled only to a first second coil and a second primary coil magnetically coupled only to a second secondary coil. The secondary coils are electrically coupled to the output terminals through a diode steering circuit for connecting both secondary coils in voltage-aiding series such that the sum of the voltages on both secondary coils is coupled across the output terminals when both primary coils are simultaneously actuated; only the first secondary coil is coupled across the output terminals when only the first primary coil is actuated; and only the second secondary coil is coupled across the output terminals when only the second primary coil is actuated.

17 Claims, 5 Drawing Sheets

IGNITION SYSTEM WITH ENHANCED COMBUSTION AND FAULT TOLERANCE

BACKGROUND

The field of the invention relates to ignition systems for internal combustion engines.

Conventional ignition systems of the Kettering type include a secondary coil having an output terminal, or tower, coupled to the center tower of a distributor. As the distributor rotor rotates in response to camshaft rotation, the secondary coil is coupled across each spark plug. The primary coil is charged by electronic switching which is timed such that a collapse in primary current is coupled to the secondary coil a desired number of crank angle degrees before a cylinder top dead-center position. As the secondary coil discharges, ignition energy is coupled to the appropriate spark plug. A problem with this type of system is that a failure in either of the coils, or associated charging circuitry, will totally disable the engine. Another problem is that the amount and duration of ignition energy remains fixed even though it would be desirable to increase ignition energy during starting and high engine speed or load operation.

Distributorless ignition systems are also known which have a plurality of secondary coils, each coupled across the center electrode of a pair of spark plugs. Each of the spark plug pairs is fired on both the compression stroke and exhaust stroke of the corresponding cylinders. For example, U.S. Pat. No. 4,462,380 issued to Asik discloses a distributorless ignition system having two primary coils, each magnetically coupled to a corresponding secondary coil. The outer terminals of each secondary coil are coupled to the center electrodes of a pair of spark plugs. In addition, a supplemental ignition module is disclosed for increasing the ignition energy supplied by the secondary coils. More specifically, each secondary coil has split center taps coupled to the supplemental ignition module. The supplementary ignition module includes a full wave bridge rectifier which charges an output capacitor. As the capacitor is discharged, additional energy is added to the secondary coils. Although this system addresses the Problem of increasing ignition energy, it does so by continuously supplying increased ignition energy. A disadvantage is, therefore, that the continuous increase in ignition energy adds stress to both the ignition system and spark plugs thereby decreasing their lifespan. An additional disadvantage is that a failure in any of the coils will disable a portion of the ignition energy supplied to the engine, possibly shutting down the entire engine. Another disadvantage is the complexity of the supplemental ignition module.

SUMMARY OF THE INVENTION

An object of the invention herein is to provide an ignition system which will continue to supply ignition energy when there is a failure in one or more of the ignition coils. Another object of the invention is for the ignition system to provide increased ignition energy only when commanded such as during start-up and high engine speed or load operation.

The above-described problems and disadvantages are overcome, and objects achieved, by the ignition system claimed herein. In one aspect of the invention, the ignition system comprises: an ignition system for providing ignition energy to the spark plugs coupled to the combustion chambers of an internal combustion engine, comprising: first and second output terminals for coupling the ignition energy to electrodes of at least one spark plug; first and second primary coils each being magnetically coupled to respective first and second secondary coils, the first secondary coil being connected between the first output terminal and a first node, the second secondary coil being connected between the second output terminal and a second node; first and second driver circuits each being responsive to first and second control signals for electrically actuating the first and second primary coils, respectively; control means for providing the first and second control signals; and circuit means for coupling electrical current through the first and second secondary coils in voltage-aiding series when the first and second primary coils are concurrently actuated and for coupling electrical current only through the first secondary coil when only the first primary coil is actuated and for coupling electrical current only through the second secondary coil only when the second primary coil is actuated, the circuit means comprising a first diode circuit having an anode connected to the first output terminal and a cathode connected to the second node, a second diode circuit having a cathode connected to the second output terminal and an anode connected to the first node, and a third diode circuit having an anode connected to the first node and a cathode connected to the second node.

In the above aspect of the invention, the control means concurrently provides the first and second control signals for providing increased ignition energy. In a further aspect of the invention, the control means pulses the first and second control signals for repetitively firing each spark plug to increase ignition energy. In still another aspect of the invention, the control means alternately provides the first control signal and the second control signal for reducing electrical stresses on the coils.

An advantage of the above aspects of the invention is that if a coil is disabled, the circuit means automatically couples the unaffected coil across the output terminals thereby preventing any interruption in ignition power. Another advantage is that increased ignition energy is supplied only when desired, such as during start-up and high engine speed, or high engine load, by coupling both secondary coils together. Still another advantage is that the secondary coils may be alternately actuated thereby reducing electronic stresses on the ignition system and prolonging its life.

BRIEF DESCRIPTION OF THE DRAWINGS

The objects and advantages described herein will be more fully understood by reading the description of the preferred embodiment with reference to the drawings, wherein.

DESCRIPTION OF THE PREFERRED EMBODIMENT

Figure 1:
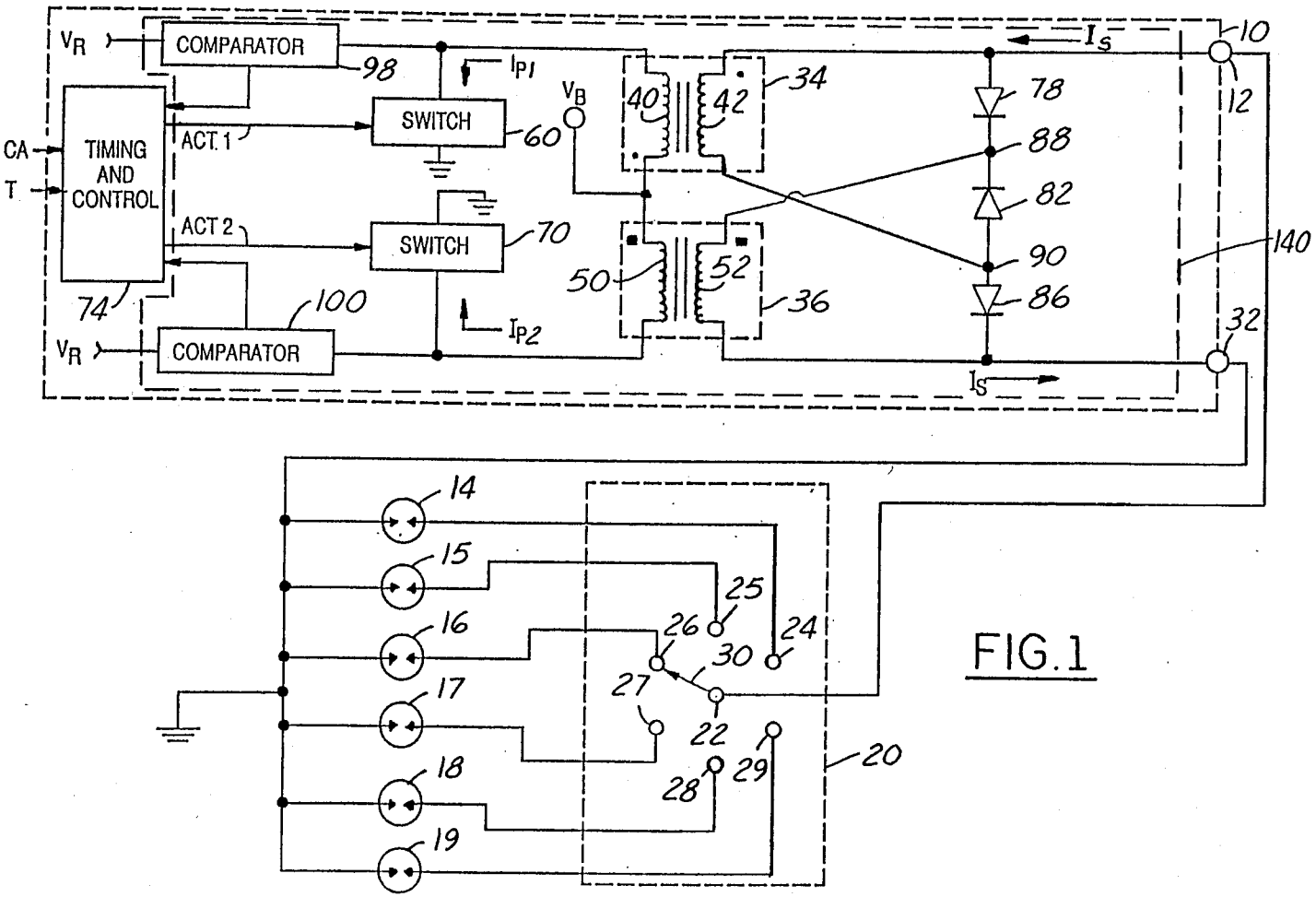
FIG. 1 is an electronic schematic of an ignition system in which the invention is used to advantage.

Referring first to FIG. 1, ignition system 10 is shown in this example having output terminal 12 coupled through an ignition tower (not shown) to the center electrode of spark plugs 14, 15, 16, 17, 18, and 19 via distributor 20. Output terminal 32 of ignition system 10 is shown coupled to the outer electrode of spark plugs 14-19 via electrical ground. Distributor 20 is shown having input tower 22 coupled to output terminal 12 and output towers 24, 25, 26, 27, 28, and 29 respectively coupled to spark plugs 14–19. Rotor 30, coupled to the engine camshaft (not shown), electrically connects input tower 22 to output towers 24–29 in a conventional manner as a function of the engine crank angle position. Although ignition system 10 is shown coupled to six spark plugs via conventional distributor 20, it may also be used to advantage with any number of spark plugs and may also be configured in a distributorless ignition system with direct coupling to the spark plugs. An example of a distributorless ignition system in which ignition system 10 is used to advantage is presented later herein with reference to FIGS. 3, 4A, 4B, and 4C.

Ignition system 10 is shown including separately wound ignition coil sections 34 and 36. Ignition coil section 34 is shown having primary coil 40 magnetically coupled to secondary coil 42 such that the dot-marked terminals always observe the same voltage polarity. Similarly, ignition coil section 36 is shown having primary coil 50 magnetically coupled to secondary coil 52 such that their dot-marked terminals observe corresponding voltage polarities.

Primary coil 40 is shown coupled between voltage source $V_B$, battery voltage in this example, and a voltage return, ground in this example, via conventional low side power switch 60. Similarly, primary coil 50 is shown coupled between $V_B$ and ground via low side power switch 70. Both power switch 60 and power switch 70 comprise conventional bipolar Darlington coupled switching transistors. It is also noted that other power switching devices such as COMFETS (sold by RCA as Part No. RCP10N 40) may be used to advantage.

Timing and control module 74 actuates switch 60 and switch 70 by generating respective control signals ACT1 and ACT2 in relation to crank angle signal CA from the engine camshaft (not shown). Typically, signals ACT1 and ACT2 are generated such that the appropriate spark plug fires a predetermined advance in crank angle degrees from the top dead-center (TDC) position of the respective cylinder. In a conventional manner, timing and control module 74 also alters the timing of signals ACTl and ACT2 as a function of engine speed, load, and temperature. As described in greater detail hereinafter, the return voltage lines from primary coils 40 and 50 are also coupled to timing and control module 74 for fault diagnosis and the performance of fault corrections by appropriate alteration of signals ACT1 and ACT2. For example, when a fault is detected on primary coil 40, such as a low switching voltage condition, timing and control module 74 actuates primary coil 50 to substitute operation of primary coil 40 with primary coil 50. Fault correction is also performed by the diode steering circuit described below.

The interconnection of secondary coils 42 and 52 through a novel diode steering circuit is now described. In general, the diode steering described hereinbelow aids in accomplishing the following: concurrently connecting secondary coils 42 and 52 in series for delivering up to twice the conventional voltage to the spark plugs (concurrent mode); or automatically connecting secondary coil 42 to the plugs when primary coil 50, or associated driving circuitry, fails; or automatically connecting secondary coil 52 to the plugs when primary coil 40, or associated driving circuitry, fails; or alternating the connection of secondary coils 42 and 52 to the plugs dependent upon operation of timing and control module 74 (alternating mode); or alternately connecting secondary coils 42 and 52 to the plugs during a single combustion event under control of timing and control module 74 to repetitively fire each plug during a single combustion event (repetitive mode).

Diode circuits 78, 82, and 86 are high voltage diodes capable of withstanding a peak reverse voltage on the order of 20 to 40 kilovolts. In this particular example, diode circuits 78, 82, and 86 each include a series interconnection of approximately 20 individual diodes commonly referred to as a diode stack. An example of an individual diode, for use in a stack, is available from Hitachi (Part No. DHG10B200). Diode circuit 78 is shown having its anode connected to output terminal 12 and its cathode connected to node 88. Diode circuit 86 is shown having its cathode connected to output terminal 32 and its anode connected to node 90. Diode circuit 82 is shown having its anode connected to node 90 and its cathode connected to node 88. Secondary coil 42 is shown connected between output terminal 12 and node 90 such that terminal 12 is driven to a high negative voltage on the collapse of primary current $I_{p1}$. Secondary coil 52 is shown connected between node 88 and output terminal 32 such that node 88 is driven to a high negative voltage on the collapse of primary current $I_{p2}$.

Figure 2A:
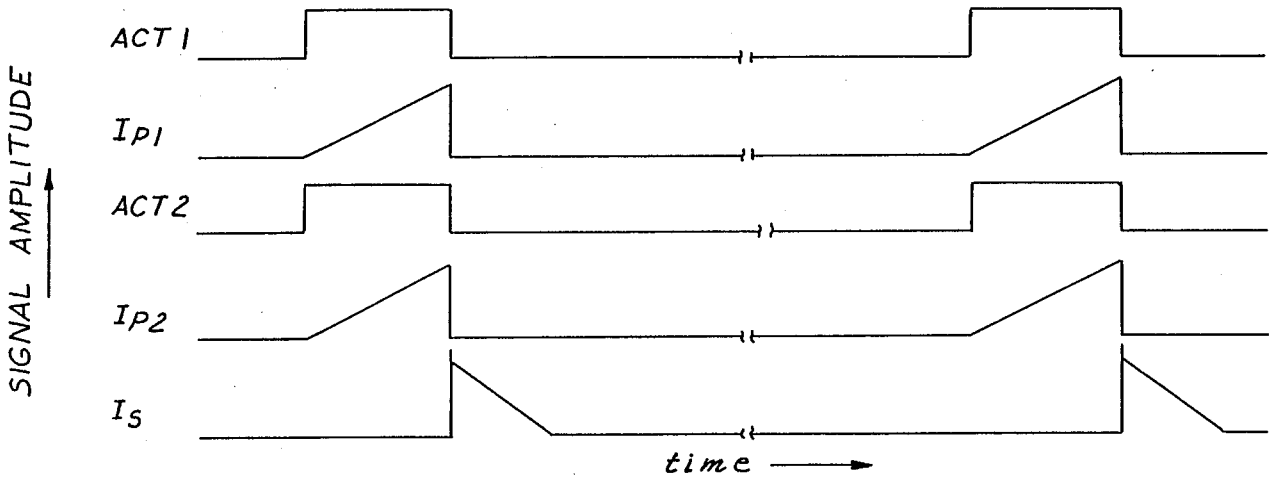
FIG. 2A shows electrical waveforms during the concurrent mode of operation of the ignition system described herein.

Referring to FIG. 2A, and continuing with FIG. 1, the operation of ignition system 10 is first described during the concurrent mode wherein both primary coils 40 and 50 are concurrently actuated. This mode is used to deliver maximum ignition energy, up to twice the conventional ignition energy, during either start-up conditions or other high voltage engine demand operation. More specifically, timing and control module 74 concurrently supplies signals ACT1 and ACT2 when engine temperature (T) is below a minimum temperature associated with start-up, or when the engine is at sufficiently high rpm. Those skilled in the art will recognize numerous other modes wherein increased ignition energy is desired such as, for example, when input voltage is reduced by the starter load. When signals ACT1 and ACT2 are actuated, switches 60 and 70 provide separate current paths from $V_B$ through respective primary coils 40 and 50 to ground. Stated another way, current $I_{p1}$ flows through primary coil 40 when signal ACT1 actuates switch 60, and current $I_{p2}$ flows through primary coil 50 when switch 70 is actuated by signal ACT2.

When signals ACT1 and ACT2 are deactuated, the collapse in current $I_{p1}$ and current $I_{p2}$ induces current $I_s$ in respective secondary coils 42 and 52. The corresponding voltage developed across secondary coils 42 and 52 bias diode circuits 78, 82, and 86 resulting in an $I_s$ current flow through secondary coil 42, diode circuit 82, and secondary coil 52. Accordingly, both secondary coils 42 and 52 are connected in voltage-aiding series providing up to double the voltage of a single secondary coil across output terminals 12 and 32.

The above-described diode steering circuit also provides automatic coil selection to overcome numerous fault conditions. For example, if current fails to be coupled to secondary coil 42, such as when primary coil 40 or associated driving circuitry fails, the voltage from secondary coil 52 biased across diode circuits 78, 82, and 86 results in a current flow through diode circuit 78, secondary coil 52, and the external terminals 32 and 12. Thus, only secondary coil 52 is coupled across output terminals 12 and 32, and secondary coil 42 is bypassed. Electrical energy is thereby automatically coupled to the spark plugs for continued operation even though a coil has failed. In the event of a failure in coupling current to secondary coil 52, such as when primary coil 50 or associated driving circuitry fails, current is coupled through secondary coil 42 and diode circuit 86. Accordingly, only secondary coil 42 is coupled across output terminals 12 and 32, bypassing secondary coil 52.

Timing and control module 74 also monitors primary coils 40 and 50 for degraded performance and, in response, selects either secondary coil 42 or secondary coil 52 for operation. More specifically, voltage comparator 98 compares the inductive flyback voltage from primary coil 40 to reference value $V_R$. If the flyback voltage is below $V_R$, indicating undesired operation, timing and control module 74 disables ACT1 and enables ACT2. In response, diode circuits 78, 82, and 86 couple secondary coil 52 across output terminals 12 and 32 as previously described. Similarly, voltage comparator 100 compares the flyback voltage from primary coil 50 to reference $V_R$. In response to a low flyback voltage, timing and control module 74 disables ACT2 and enables ACT1 thereby coupling secondary coil 42 across output terminals 12 and 32 by operation of diode steering as previously described herein.

Figure 2B:
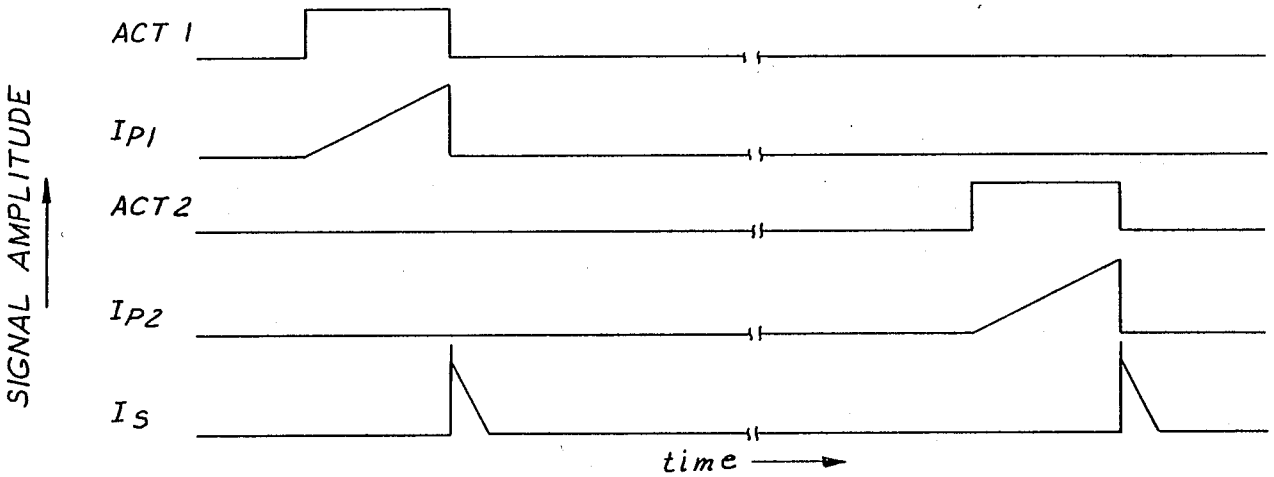
FIG. 2B shows electrical waveforms during the alternating mode of operation of the ignition system described herein.

The alternating mode of operation, wherein primary coils 40 and 50 of respective coil sections 34 and 36 are alternately actuated, is now described with Particular reference to the waveforms shown in FIGS. 2B. It is seen that timing and control module 74 alternately actuates signals ACT1 and ACT2 such that one or the other, but not both, is actuated an appropriate number of crank angle degrees before the top dead-center position of each cylinder compression stroke. In this particular example, wherein a six cylinder engine is shown, signals ACT1 and ACT2 are separated by 120 crank angle degrees. When ignition system 10 is used in a four cylinder engine, for example, signals ACT1 and ACT2 are separated by 180 degrees.

Primary coil 40 is first charged during signal ACT1. As current $I_{p1}$ collapses in primary coil 40, the induced current in secondary coil 42 results in voltage biases on the diode circuits (78, 82, and 86) which enables $I_s$ to flow through secondary coil 42 and diode circuit 86. Thus, only secondary coil 42 is connected across output terminals 12 and 32 during the spark plug firing associated with signal ACT1. The next spark plug firing is initiated in response to signal ACT2. Current is induced in secondary coil 52 from primary coil 50. Accordingly, $I_s$ flows through diode circuit 78 and secondary coil 52 thereby coupling secondary coil 52 across output terminals 12 and 32.

In the event a fault is detected in either the primary or secondary circuits, such as by monitoring flyback voltage as previously described herein, timing and control module 74 disables the faulty circuit and enables the other circuit by appropriate selection of signal ACT1 or ACT2.

An advantage of the alternating mode is that each pair of coils is actuated only one-half the time of a conventional system thereby reducing component stresses and prolonging system life. Another advantage is that in the event of a failure, the alternate pair of coils is selected such that the engine continues to operate in a normal manner.

Figure 2C:
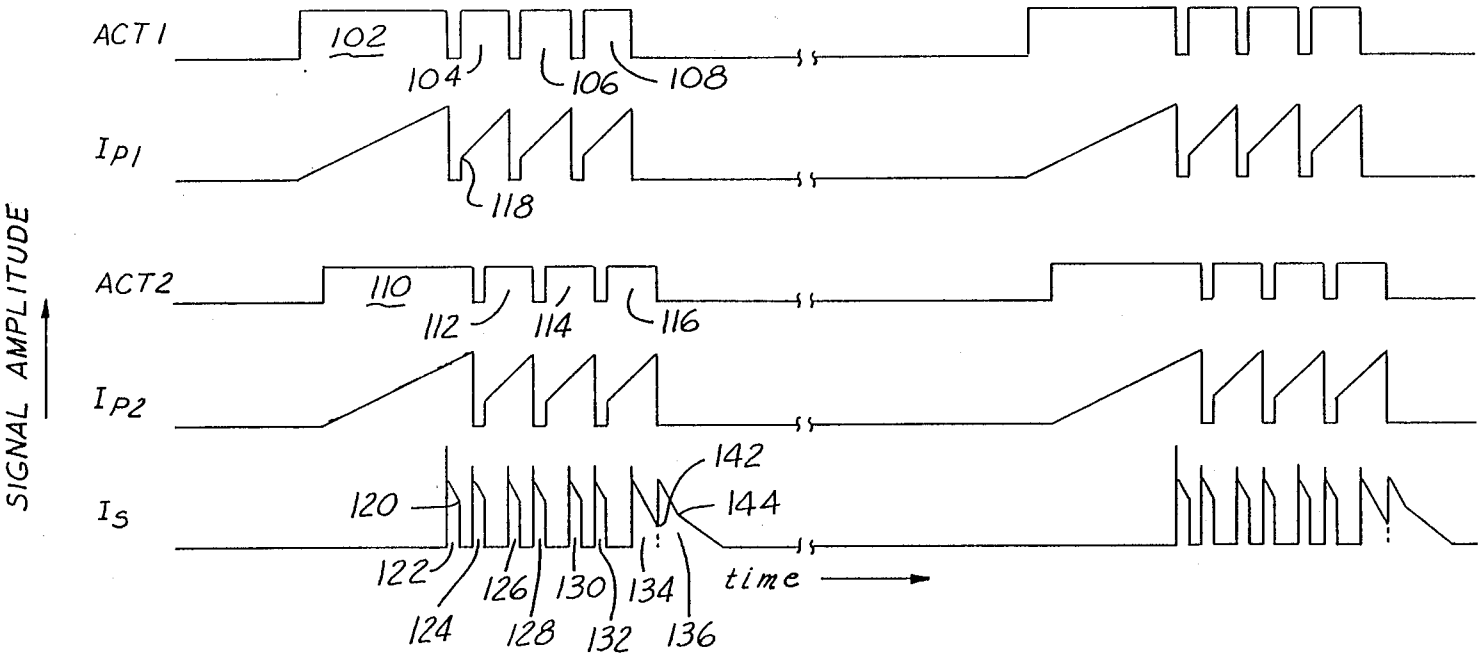
FIG. 2C shows electrical waveforms associated with the repetitive mode of operation of the ignition system described herein.

The repetitive mode is now described with particular reference to FIG. 2C. In general terms, cylinder combustion is improved by repetitively providing breakdown voltage to the spark plugs over a prolonged time period for a single combustion event. For the particular example illustrated by FIG. 2C, the time period during which ignition energy is supplied is greatly increased over the embodiment shown in FIG. 2B. As described in greater detail hereinafter, the repetition rate, individual pulse duration, and time period during which ignition energy is supplied are all selectable by appropriate manipulation of signals ACT1 and ACT2. More specifically, signal ACT1 is shown generated by timing and control module 74 with first pulse 102, having the same pulse width as shown in the previous examples presented with particular reference to FIGS. 2A and 2B. Signal ACT1 is also shown including subsequent pulses 104, 106, and 108, each having approximately ⅓ the pulse width of pulse 102 and an interpulse separation 1/12th the pulse width of pulse 102. Signal ACT2 is shown having the same pulse train (pulses 110, 112, 114, and 116) as signal ACT1, but delayed by a time equivalent to 1/6th the pulse width of pulse 102. Stated another way, pulses 110, 112, 114, and 116 have the same pulse width and are generated in the same order as respective pulses 102, 104, 106, and 108, but are phase-shifted by 1/6th the pulse width of pulse 102.

In operation, during pulse 102, current $I_{p1}$ charges primary coil 40. After the trailing edge of pulse 102, current $I_s$ flows through secondary coil 42 and diode circuit 86 applying energy across terminals 12 and 32 for spark ignition. At the rising edge of pulse 104, primary coil 40 begins to be recharged before all the energy stored therein is expended in the spark gap. This remaining stored energy is shown graphically by numeral 118 in FIG. 2C. Thus, primary coil 40 is charged faster than the embodiments described hereinabove with particular reference to FIGS. 2A and 2B. Further, the change in voltage direction impressed on primary coil 40 in response to pulse 104 changes the biasing of secondary coil 42 thereby shutting off $I_s$ as shown by numeral 120 in FIG. 2C. Accordingly, the spacing between the falling edge of pulse 102 and rising edge of pulse 104 essentially defines the pulse width of the first $I_s$ pulse shown as $I_s$ pulse 122 in FIG. 2C.

In a manner similar to that described above with reference to $I_s$ pulse 122, subsequent $I_s$ pulse 126 is formed in response to the falling edge of pulse 104 and rising edge of pulse 106, and subsequent $I_s$ pulse 130 is formed in response to the falling edge of pulse 106 and rising edge of pulse 108.

Subsequent $I_s$ pulses 124, 128, and 132 are formed in a manner similar to that described above, except that they are formed in response to ACT2 pulses 110, 112, 114, and 116, primary coil 50, and secondary coil 52. More specifically, during pulse 110, current $I_{p2}$ charges primary coil 50. After the trailing edge of pulse 110, $I_s$ flows through diode stack 78 and secondary coil 52 until the rising edge of pulse 112 thereby defining the pulse width $I_s$ pulse 124. Subsequent $I_s$ pulses 128 and 132 are formed in response to the rising and falling edges of pulses 112, 114, and 116 in a similar manner to that described with respect to $I_s$ pulse 124.

Subsequent $I_s$ pulse 134 begins after falling edge of ACT1 pulse 108 as $I_s$ flows through secondary coil 42 and diode circuit 86. $I_s$ discharges through the spark gap until the falling edge of pulse 116 (as designated by numeral 149 on $I_s$ pulse 136). At the falling edge of pulse 116, energy is coupled from primary coil 50 to secondary coil 52 thereby defining the start of $I_s$ pulse 136. As the current available from coil 52 exceeds that established in coil 42, coil 52 becomes the source of current flowing through the spark gap path (from terminal 32 and back through terminal 12). At the junction of the anode of diode circuit 78 and the dot-marked terminal of coil 42, the current $I_s$ splits into two components: one portion (equal to that already established in coil 42) flows through coil 42 into diode circuit 82 at node 90 and joins the other component of current which flowed through diode circuit 78 to node 88. The two current components rejoin at node 88 and complete the circuit into coil 52. The effect of this current action is to sustain the current through coil 42 at near zero potential difference until $I_s$ (sourced from coil 52) is diminished to the same level as energy is delivered to the spark gap. At this time (identified by numeral 144), the current component through diode circuit 78 has decayed to zero and the energy remaining in coil 42 is added in series (through diode circuit 82) to that in coil 52 to source the spark gap current. As $I_s$ discharges into the spark gap, $I_s$ pulse 136 decays to zero as shown in FIG. 2C at a slower rate of change due to the larger inductive source of current (the sum of inductance of coils 42 and 52).

It is apparent from the foregoing that the pulse width of each $I_s$ pulse is defined by the interpulse spacing between each ACT signal. The spacing between the pulses (repetition rate) is defined by the phase difference between signals ACT1 and ACT2. Thus, any desired pulse width and any repetition rate are obtained through appropriate generation of signals ACT1 and ACT2 by timing and control module 74. It is also noted that the prolonged rate of discharge illustrated by pulse 136 may occur at any location with respect to signals ACT1 and ACT2 by appropriate phase manipulation of these signals.

Figure 3:
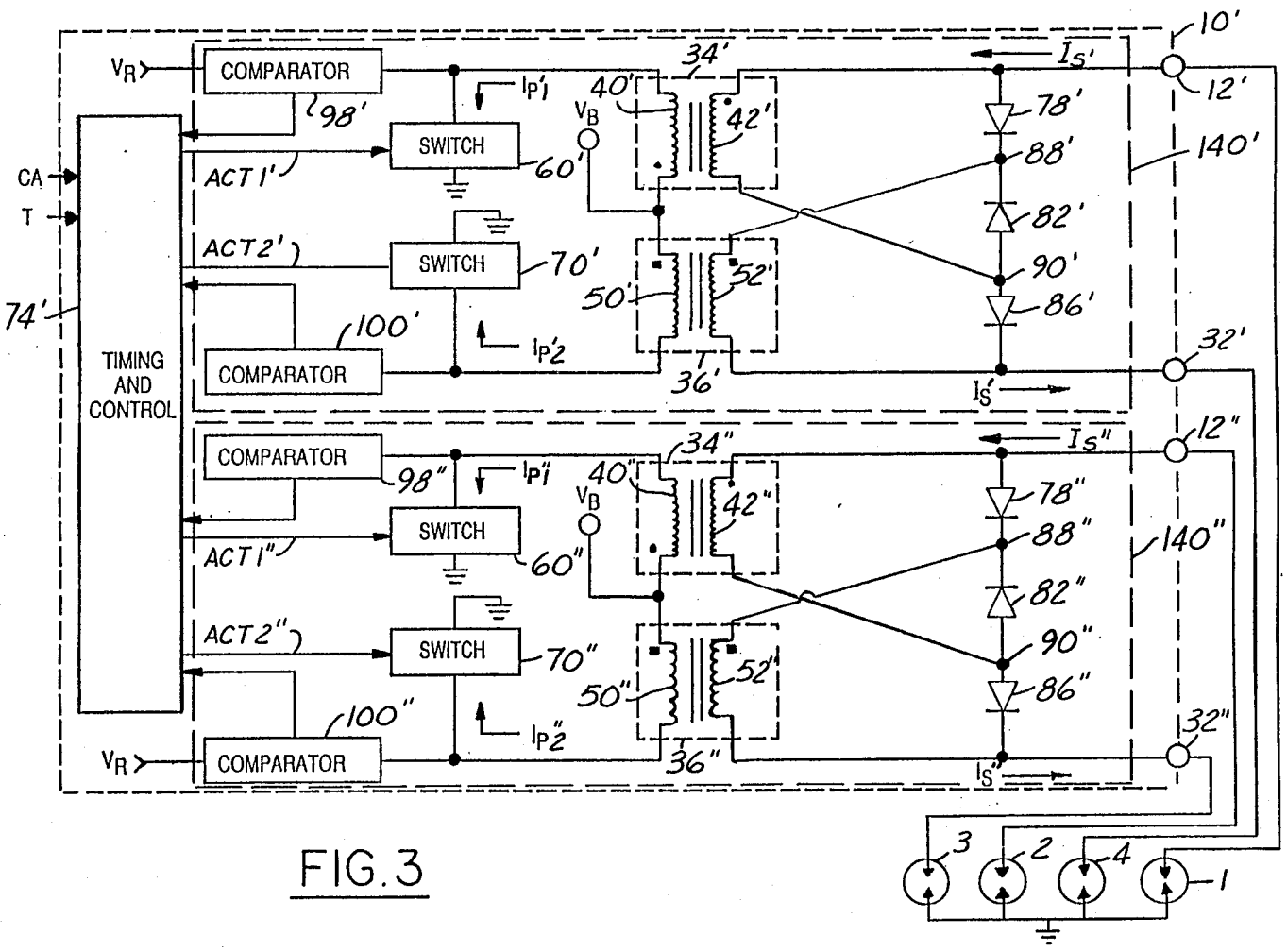
FIG. 3 shows an electronic schematic of another embodiment in which the ignition system described herein is used to advantage.

An alternate embodiment is shown in FIG. 3 wherein like numerals refer to like components and like signals shown in FIGS. 1, 2A, 2B, and 2C. The alternate embodiment is an example of applying ignition system 10' as a distributorless ignition system on a four cylinder engine. In this particular example, ignition system 10' is shown having ignition channel 140' and 140'', each responsive to timing and control module 74'. It is noted that ignition system 10 was shown in FIG. 1 having a single ignition channel 140 responsive to timing and control module 74.

Channel 140' of ignition system 10' is shown having output terminals 12' and 32' coupled to the center electrodes of respective spark plugs 1 and 4. Channel 140'' is shown having output terminals 12'' and 32'' coupled to the center electrodes of respective spark plugs 2 and 3. The outer electrodes of plugs 1–4 are shown coupled to ground. Accordingly, plugs 1 and 4 are fired simultaneously as are plugs 2 and 3. It is noted with reference to FIG. 4A that the stroke of combustion chambers 1 and 4 are separated by 360 crank angle degrees. Similarly, combustion chambers 2 and 3 are separated by 360 crank angle degrees such that while one combustion chamber is in a compression stroke, the other combustion chamber is in an exhaust stroke. Thus, plugs 1 and 4 fire simultaneously on both the compression and exhaust strokes, and plugs 2 and 3 fire simultaneously on both the compression and exhaust strokes.

Those skilled in the art will recognize that when ignition system 10' is configured as a distributorless ignition system, one ignition channel is coupled to a pair of plugs such that the number of ignition channels is equal to the number of combustion chambers divided by two. For example, a six cylinder engine utilizes three ignition channels.

The operation of ignition system 10' during the concurrent operating mode, alternating operating mode, and repetitive operating mode is similar to the corresponding operation of ignition system 10 described hereinabove with particular reference to FIGS. 2A (concurrent mode), 2B (alternating mode), and 2C (repetitive mode), respectively.

Figures 4A, 4B, 4C:
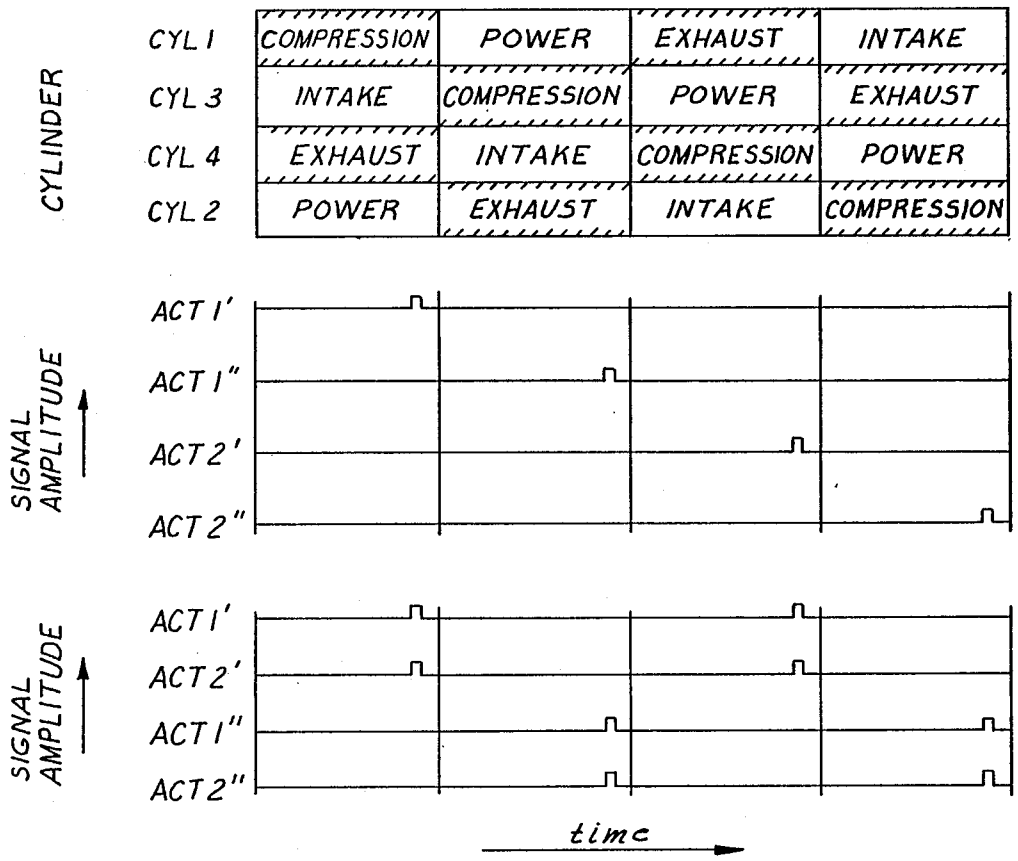
FIG. 4A shows a timing diagram of the power, compression, intake, and exhaust strokes of an engine which is coupled to the ignition system shown in FIG. 3.
FIG. 4B shows electrical waveforms associated with both the alternating mode and repetitive mode of operation of the ignition system shown in FIG. 3, the waveforms shown in FIG. 4B are shown is more detail in FIGS. 2B and 2C.
FIG. 4C shows electrical waveforms associated with the concurrent mode of operation of the ignition system shown in FIG. 3, the waveforms shown in FIG. 4C are shown in more detail in FIG. 2A.

During the alternate operating mode of ignition system 10', coil sections 34' and 36' of ignition channel 140' are alternately actuated by signals ACT1' and ACT2' as shown in FIG. 4B. Similarly, coil sections 34'' and 36'' of ignition channel 140'' are alternately actuated by signals ACT1'' and ACT2'' as shown in FIG. 4B. The operation and advantages, including fault correction, of ignition channels 140' and 140'' are substantially the same as the operation of ignition channel 140 described previously herein with particular reference to FIG. 2B.

During the concurrent mode of operation, coil sections 34' and 36' of ignition channel 140' are concurrently actuated by signals ACT1' and ACT2' as shown in FIG. 4C. Similarly, coil sections 34'' and 36'' of ignition channel 140'' are concurrently actuated by signals ACT1'' and ACT2'' as shown in FIG. 4C. The operation and advantages, including fault correction, of ignition channels 140' and 140'' in the concurrent mode of operation are substantially the same as ignition channel 140 described previously herein with particular reference to FIG. 2A.

In the repetitive mode of operation, coil sections 34' and 36' of ignition channel 140' are actuated in the repetitive manner described in FIG. 2C as are coil sections 34'' and 36'' of ignition channel 140''. The operation and advantages of ignition channels 140' and 140'' are substantially the same as ignition channel 140 described previously herein with particular reference to FIG. 2C.

This concludes the description of the preferred embodiment. The reading of it by those skilled in the art will bring to mind many alterations and modifications without departing from the spirit and scope of the invention. For example, the ignition system described herein may be used to advantage with either a distributor-type ignition or a distributorless ignition system. Accordingly, it is intended that the scope of the invention be limited by only the following claims.

What is claimed:

1. An ignition system for providing ignition energy to the spark plugs coupled to the combustion chambers of an internal combustion engine, comprising:

first and second output terminals for coupling the ignition energy to electrodes of at least one spark plug;

first and second primary coils each being magnetically coupled to respective first and second secondary coils, said first secondary coil being connected between said first output terminal and a first node, said second secondary coil being connected between said second output terminal and a second node; and circuit means comprising a first diode circuit having an anode connected to said first output terminal and a cathode connected to said second node, a second diode circuit having a cathode connected to said second output terminal and an anode connected to said first node, and a third diode circuit having an anode connected to said first node and a cathode connected to said second node.

2. The ignition system recited in claim 1 wherein said first output terminal is coupled to an ignition distributor.

3. The ignition system recited in claim 1 wherein said first output terminal is coupled to a center electrode of a first spark plug and said second output terminal is coupled to a center electrode of a second spark plug.

4. An ignition system for providing ignition energy to the spark plugs coupled to the combustion chambers of an internal combustion engine, comprising:

first and second output terminals for coupling the ignition energy to electrodes of at least one spark plug;

first and second primary coils each being magnetically coupled to respective first and second secondary coils, said first secondary coil being connected between said first output terminal and a first node, said second secondary coil being connected between said second output terminal and a second node;

first and second driver circuits each being responsive to first and second control signals for electrically actuating said first and second primary coils, respectively;

control means for providing said first and second control signals; and circuit means for coupling electrical current through said first and second secondary coils when said first and second primary coils are concurrently actuated and for coupling electrical current only through said first secondary coil when only said first primary coil is actuated and for coupling electrical current only through said second secondary coil only when said second primary coil is actuated, said circuit means comprising a first diode circuit having an anode connected to said first output terminal and a cathode connected to said second node, a second diode circuit having a cathode connected to said second output terminal and an anode connected to said first node, and a third diode circuit having an anode connected to said first node and a cathode connected to said second node.

5. The ignition system recited in claim 4 wherein said control means concurrently provides said first control signal and said second control signal.

6. The ignition system recited in claim 4 wherein said control means alternately provides said first control signal and said second control signal.

7. The ignition system recited in claim 4 wherein said control means provides said first control signal having a first pulse train for repetitively actuating said first secondary coil so that said first secondary coil provides a plurality of first energy pulses each having a pulse width directly related to the interpulse spacing of said first pulse train.

8. The ignition system recited in claim 7 wherein said control means provides said second control signal having a second pulse train for repetitively actuating said second secondary coil so that said second secondary coil provides a plurality of second energy pulses each having a pulse width directly related to the interpulse spacing of said second pulse train.

9. The ignition system recited in claim 8 wherein said control means provides said second pulse train with a phase shift from said first pulse train directly related to the spacing between each of said first energy pulses and said second energy pulses.

10. The ignition system recited in claim 4 further comprising distributor means for coupling said first output terminal selectively to the center electrode of each of said spark plugs, and wherein said second output terminal is coupled to the outer electrodes of all of the spark plugs.

11. The ignition system recited in claim 10 wherein said second output terminal is coupled to ground.

12. The ignition system recited in claim 4 wherein said first output terminal is coupled to the center electrode of one spark plug and the second output terminal is coupled to the center electrode of another spark plug.

13. The ignition system recited in claim 12 wherein the combustion chamber coupled to said one spark plug is on a compression stroke when the combustion chamber coupled to said another spark plug is on an exhaust stroke.

14. An ignition system for providing ignition energy to the spark plugs coupled to the combustion chambers of an internal combustion engine, comprising:

first and second output terminals for coupling the ignition energy to electrodes of at least one spark plug;

first and second primary coils each being magnetically coupled to respective first and second secondary coils, said first secondary coil being connected between said first output terminal and a first node, said second secondary coil being connected between said second output terminal and a second node;

first and second driver circuits each being responsive to a first control signal and a second control signal for electrically actuating said first and second primary coils, respectively;

fault detection means coupled to said first primary coil and said second primary coil for providing a first fault indication related to faulty operation of said first primary coil and a second fault indication related to faulty operation of said second primary coil;

control means for providing said first and second control signals, said control means disabling said first control signal and enabling said second control signal in response to said first fault indication, said control means also disabling said second control signal and enabling said first control signal in response to said second fault indication; and circuit means comprising a first diode circuit having an anode connected to said first output terminal and a cathode connected to said second node, a second diode circuit having a cathode connected to said second output terminal and an anode connected to said first node, and a third diode circuit having an anode connected to said first node and a cathode connected to said second node.

15. The ignition system recited in claim 14 wherein said control means provides said first control signal having a first pulse train for repetitively actuating said first secondary coil so that said first secondary coil provides a plurality of first energy pulses each having a pulse width directly related to the interpulse spacing of said first pulse train.

16. The ignition system recited in claim 15 wherein said control means provides said second control signal having a second pulse train for repetitively actuating said second secondary coil so that said second secondary coil provides a plurality of second energy pulses each having a pulse width directly related to the interpulse spacing of said second pulse train.

17. The ignition system recited in claim 16 wherein said control means provides said second pulse train with a phase shift from said first pulse train directly related to the spacing between each of said first energy pulses and said second energy pulses.

* * * * *